US009771135B2

(12) United States Patent
Wang et al.

(10) Patent No.: US 9,771,135 B2
(45) Date of Patent: Sep. 26, 2017

(54) BIONIC PECTORAL FIN PROPELLING DEVICE BASED ON PLANETARY GEAR TRAIN

(71) Applicant: JIANGSU UNIVERSITY OF SCIENCE AND TECHNOLOGY, Jiangsu (CN)

(72) Inventors: Shuyan Wang, Jiangsu (CN); Xinguo Wang, Jiangsu (CN); Yongmei Zhu, Jiangsu (CN); Jian Zhang, Jiangsu (CN); Wenxian Tang, Jiangsu (CN)

(73) Assignee: Jiangsu University of Science and Technology, Jiangsu (CN)

( * ) Notice: Subject to any disclaimer, the term of this patent is extended or adjusted under 35 U.S.C. 154(b) by 0 days.

(21) Appl. No.: 15/316,770

(22) PCT Filed: Jun. 1, 2015

(86) PCT No.: PCT/CN2015/080454
§ 371 (c)(1),
(2) Date: Dec. 6, 2016

(87) PCT Pub. No.: WO2016/004800
PCT Pub. Date: Jan. 14, 2016

(65) Prior Publication Data

US 2017/0152011 A1 Jun. 1, 2017

(30) Foreign Application Priority Data

Jul. 8, 2014 (CN) ..... 2014 1 0364087

(51) Int. Cl.
*B63H 1/30* (2006.01)
*B63H 1/36* (2006.01)
(Continued)

(52) U.S. Cl.
CPC ..... *B63H 1/32* (2013.01); *B63G 8/001* (2013.01); *B63H 23/02* (2013.01);
(Continued)

(58) Field of Classification Search
CPC .. B63H 1/32; B63H 23/02; B63H 2023/0283; B63G 8/001; B63G 2008/002; B63B 2754/00
(Continued)

(56) References Cited

U.S. PATENT DOCUMENTS 5,401,196 A * 3/1995 Triantafyllou ..... B63H 1/36 416/83
2006/0000137 A1* 1/2006 Valdivia y Alvarado ..... A01K 85/01 43/42.2

FOREIGN PATENT DOCUMENTS

CN 1373308 A 10/2002
CN 1785747 A 6/2006
(Continued)

OTHER PUBLICATIONS

International Search Report and Written Opinion by State Intellectual Property Office of the P.R. China of PCT/CN2015/080454, dated Aug. 28, 2015.
(Continued)

*Primary Examiner* — Anthony Wiest
(74) *Attorney, Agent, or Firm* — Edwin S. Flores; Chalker Flores, LLP

(57) ABSTRACT

A bionic pectoral fin propelling device based on a planetary gear train, including a frame, a power source (1), a propelling part (2), left and right maneuvering parts (3), a fixed support plate (4), a movable support plate (5), a left pectoral fin (6), a right pectoral fin (7), a fish body (8), and a tail fin (9). The fixed support plate (4) and the movable support
(Continued)

plate (5) are installed on the frame parallel to each other; the fixed support plate (4) is located in front of the movable support plate (5); and the left and right maneuvering parts (3) are located between the fixed support plate (4) and the movable support plate (5). The present invention solves the problem that the two pectoral fins are not synchronized, realizes variable speed propelling and left/right maneuvering, facilitates increasing the bearing capacity of the propelling device, and is particularly suitable in limited space applications.

8 Claims, 3 Drawing Sheets

(51) Int. Cl.
*B63H 1/32* (2006.01)
*B63H 23/02* (2006.01)
*B63G 8/00* (2006.01)

(52) U.S. Cl.
CPC .... *B63B 2754/00* (2013.01); *B63G 2008/002* (2013.01); *B63H 2023/0283* (2013.01)

(58) Field of Classification Search
USPC ..... 440/13, 14
See application file for complete search history.

(56) References Cited

FOREIGN PATENT DOCUMENTS

| | | | | |
|---|---|---|---|---|
| CN | 101249881 | A | | 8/2008 |
| CN | 101665147 | A | | 3/2010 |
| CN | 104149955 | A | | 11/2014 |
| CN | 203996848 | U | | 12/2014 |
| JP | 2008044545 | A | * | 2/2008 |
| WO | 2016004800 | A1 | | 1/2016 |

OTHER PUBLICATIONS

Machine Translation of WO2016004800.
Machine Translation of CN1373308.
Machine Translation of CN1785747.
Machine Translation of CN101249881.
Machine Translation of CN101665147.
Machine Translation of CN203996848.
Machine Translation of CN104149955.

* cited by examiner

BIONIC PECTORAL FIN PROPELLING DEVICE BASED ON PLANETARY GEAR TRAIN

CROSS-REFERENCE TO RELATED APPLICATIONS

This application is the National Stage of International Application No. PCT/CN2015/080454, filed on 1 Jun. 2015 claiming the priority of CN 201410364087.0 filed on 8 Jul. 2014, the content of each of which is incorporated by reference herein.

FIELD OF THE INVENTION

The present invention relates to a device in the technical field of fish-like propelling, and more particularly to a pectoral fin propelling device of a bionic robot fish.

DESCRIPTION OF RELATED ART

Fishes are products of natural evolution, and scholars both at home and abroad increasingly pay attention to the excellent swimming capability of the fishes. Median/paired fin propulsion, as a main propelling mode, has obvious advantages in the aspects of swimming flexibility, attitude stability, sinking/floating control, and positioning and the like. The study of median/paired fin propulsion and the innovative design for mechanisms are of great significance in solving problems such as maneuverability and stability of a fish body.

It is found by document retrieval of the prior art that, Chinese Patent Publication No. CN101665174, published on Feb. 2, 2012 and entitled ROBOT FISH WITH FLEXIBLY SWINGING PECTORAL FINS, describes a robot fish with flexibly swinging pectoral fins, in which the main principle of the robot fish is to convert rotation of a motor into swinging of pectoral fin connecting rods through a cam roller mechanism. Chinese Patent Publication No. CN100340452C, published on Oct. 3, 2007 and entitled PECTORAL FIN STRUCTURE OF BIONIC ROBOT FISH, in which the main principle of the patent is to transmit rotation to gear shafts and bevel gears through three steering engines. The pectoral fins can be driven to make the flapping motion when the rotation is transmitted to the gear shafts, and the pectoral fins can be driven to make the rotary motion when the rotation is transmitted to the bevel gears.

The above patents realize bionic pectoral fin propelling by different principles, but have the following obvious disadvantages: 1) Patent 1 adopts a cam mechanism to realize reciprocating swinging of the pectoral fin connecting rods, and because the cams have the defect that the swinging amplitude cannot be adjusted after geometric parameters are set, the pectoral fin connecting rods have limited motion patterns; 2) Patent 1 adopts two identical sets of cam mechanisms to realize swinging of the left and right pectoral fins, and a gear mechanism needs to be added to solve the problem of synchronization of the cams; 3) Patent 2 adopts two pectoral fins, forward and reverse rotation is transmitted to the gear shafts through two steering engines respectively, the pectoral fins are driven to make reciprocating flapping through gear rotation, and the control of the reciprocating motion of the pectoral fins depends on the steering engines; 4) a gear mechanism is inevitably used in the two pectoral fin propelling devices above, so that the whole propelling devices are rather complex; 5) the steering engines and the cam mechanisms have inadequate bearing capacities, and thus the propelling devices are limited in applications requiring high propulsion.

SUMMARY OF THE INVENTION

Technical Problem

The present invention is directed to provide a bionic pectoral fin swinging robot-fish propelling device that has a simple and compact structure and large bearing capacity, and is particularly suitable in limited space applications.

Technical Solution

To achieve the above objective, the present invention adopts the following technical solution:

A bionic pectoral fin propelling device based on a planetary gear train includes a frame, a power source, a propelling part, left and right maneuvering parts, a fixed support plate, a movable support plate, a left pectoral fin, a right pectoral fin, a fish body, and a tail fin. The fixed support plate and the movable support plate are installed on the frame parallel to each other; the fixed support plate is located in front of the movable support plate; and the left and right maneuvering parts are located between the fixed support plate and the movable support plate.

The propelling part includes a drive servo motor, a coupler, a transmission shaft, a planetary carrier, a double-disc planetary gear, a sun gear, a double-end stud, a left pectoral fin connecting rod, a right pectoral fin connecting rod, a left swinging block, a left swinging block fixing rod, a right swinging block, and a right swinging block fixing rod. The drive servo motor is fixed on the fixed support plate, an output shaft of the drive servo motor is connected to one end of the transmission shaft through the coupler, and the other end of the transmission shaft is connected to the planetary carrier. An output shaft of the planetary carrier is connected to the central part of the double-disc planetary gear through a bearing. The planetary gear includes an upper disc and a lower disc that are in parallel with each other, an outer gear of the lower disc is engaged with an inner gear of the sun gear, and a plurality of equally spaced threaded holes is provided on the periphery of a reference circle of the upper disc. The sun gear is fixed on the frame and is located in front of the fixed support plate. One end of the double-end stud is installed in one of the threaded holes of the upper disc, and the other end of the double-end stud is hinged to the left pectoral fin connecting rod and the right pectoral fin connecting rod. One end of the left swinging block fixing rod and one end of the right swinging block fixing rod are installed on the left and right sides of the movable support plate respectively, the left swinging block and the right swinging block are fixed on the other end of the left swinging block fixing rod and the other end of the right swinging block fixing rod respectively, and the left pectoral fin connecting rod and the right pectoral fin connecting rod pass through the left swinging block and the right swinging block, and are hinged to the left swinging block and the right swinging block, respectively.

The left and right maneuvering parts include an upper dovetail guide rail, an upper slide block, a lower dovetail guide rail, a lower slide block, a rack, and a forward and reverse servo motor provided with a gear on a motor shaft. The upper dovetail guide rail and the lower dovetail guide rail are respectively fixed on an upper end and a lower end of a front end surface of the movable support plate, the upper slide block and the lower slide block are respectively fixedly installed on an upper end and a lower end of a rear end surface of the fixed support plate, and the upper dovetail guide rail and the lower dovetail guide rail are respectively in sliding fit with the upper slide block and the lower slide block. The rack is fixed on a central position of the front end surface of the movable support plate. The forward and reverse servo motor is fixed on the rear end surface of the fixed support plate, and a motor gear engaged with the rack is installed on an output shaft of the forward and reverse servo motor.

The central parts of the two disc gears in the double-disc planetary gear of the present invention are fixedly connected to each other.

The bearing between the output shaft of the planetary carrier and the double-disc planetary gear in the present invention includes a first deep-groove ball bearing and a second deep-groove ball bearing, the second deep-groove ball bearing and the first deep-groove ball bearing contact each other and are installed in the front-back direction, and a rear end of the first deep-groove ball bearing is limited by a shaft shoulder of the planetary carrier.

The present invention further includes a sleeve and a baffle plate, a front end of the second deep-groove ball bearing is limited by the sleeve, and an upper end of the sleeve is pressed by the baffle plate.

The present invention further includes a first nut, the baffle plate is tightly pressed on the sleeve by using the first nut, and a gap remains between the baffle plate and the double-disc planetary gear.

The present invention further includes a key, and the transmission shaft is connected to the planetary carrier through the key.

The present invention further includes a sun gear support pillar, and the sun gear is fixedly connected to the frame through the sun gear support pillar.

The double-end stud of the present invention includes a butt end and a tip end, the butt end of the double-end stud is connected to the double-disc planetary gear, and the left pectoral fin connecting rod and the right pectoral fin connecting rod are hinged at the tip end of the double-end stud.

Advantageous Effect

Compared with the existing pectoral fin propelling devices, the present invention has the following advantages: 1) Conversion to reciprocating swinging of the two pectoral fins is realized by using a special K_H_V planetary gear train, and the problem that the two pectoral fins are not synchronized is avoided. 2) By changing the absolute distance between the left and right swinging blocks, the reciprocating swinging amplitude of the pectoral fins can be changed and variable speed propelling can be realized; and by changing the relative distances from the left and right swinging blocks to the center of the sun gear, the two pectoral fins may swing by unequal angles, thereby realizing left and right maneuvering. 3) The gear mechanism used as a motion conversion mechanism has larger bearing capacity than the cam mechanism, and facilitates increasing the bearing capacity of the propelling device. 4) The planetary gear train has high space utilization and has a simple and compact structure, is particularly suitable in limited space applications, and can be generalized to apply to micro underwater devices, micro unmanned underwater detectors and the like. 5) Based on accomplishment of the motion conversion, the planetary gear can be easily integrated with a speed reducer in the design, facilitating the use in marine propelling applications under high-load operating conditions.

DETAILED DESCRIPTION OF THE INVENTION

Figure 1:
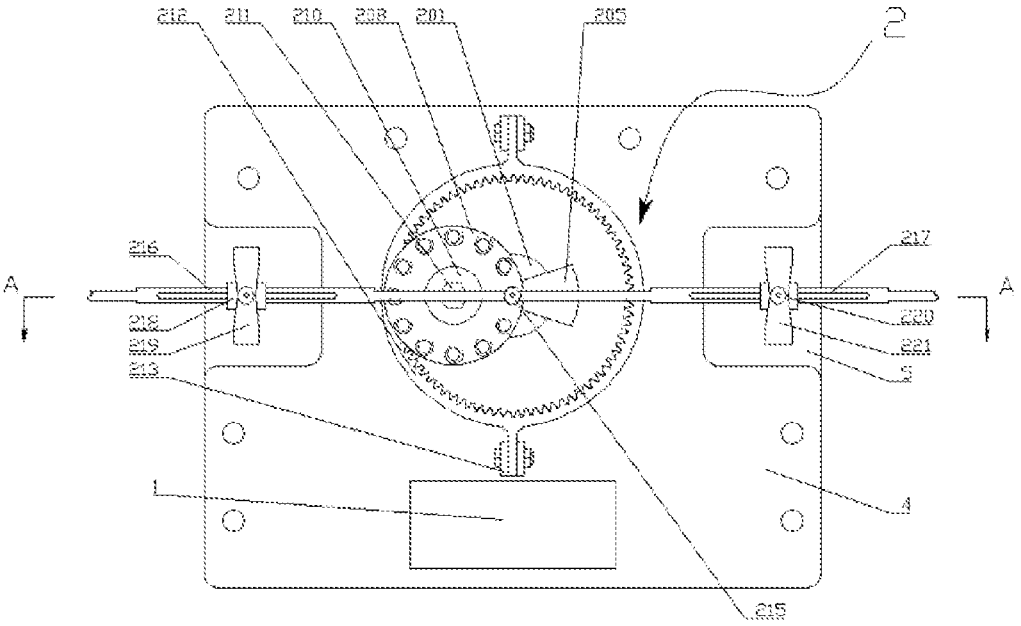
FIG. 1 is a front view of a bionic pectoral fin propelling device according to the present invention.

In order to make the objectives and technical solutions of the embodiments of the present invention clearer, the technical solutions of the embodiments of the present invention are clearly and completely described below with reference to the accompanying drawings of the embodiments of the present invention. It is obvious that the described embodiments are merely some rather than all embodiments of the present invention. Based on the described embodiments of the present invention, all other embodiments obtained by persons of ordinary skill in the art without making creative efforts shall fall within the protection scope of the present invention.

One of ordinary skill in the art can understand that unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art, and will not be interpreted in an idealized or overly formal sense unless expressly so defined herein.

The term "and/or" in the present invention means that either or both elements may be present.

The terms "inner" and "outer" in the present invention respectively refer to, relative to the device itself, the direction toward the interior of the device and the opposite direction, and are not intended to particularly limit the device and mechanism of the present invention.

The terms "left" and "right" in the present invention respectively refer to, when a reader is facing the drawing, the left side of the reader and the right side of the reader, and are not intended to particularly limit the device and mechanism of the present invention.

The term "connection" in the present invention may refer to direct connection between components or indirection connection between components by means of other components.

The terms "front" and "back" in the present invention respectively refer to the traveling direction of a propelling device in operation and the opposite direction.

As shown in FIG. 1, FIG. 2, FIG. 3, FIG. 4, and FIG. 5, the present invention provides a bionic pectoral fin propelling device based on a planetary gear train, which includes a power source 1, a propelling part 2, left and right maneuvering parts 3, a fixed support plate 4, a movable support plate 5, a left pectoral fin 6, a right pectoral fin 7, a fish body 8, and a tail fin 9. The propelling part 2 includes a drive servo motor 201, a coupler 202, a transmission shaft 203, a key 204, a planetary carrier 205, a first deep-groove ball bearing 206, a second deep-groove ball bearing 207, a double-disc planetary gear 208, a sleeve 209, a baffle plate 210, a first nut 211, a sun gear 212, a sun gear support pillar 213, a double-end stud 214, a second nut 215, a left pectoral fin connecting rod 216, a right pectoral fin connecting rod 217, a left swinging block 218, a left swinging block fixing rod 219, a right swinging block 220, and a right swinging block fixing rod 221. The left and right maneuvering parts 3 include an upper dovetail guide rail 301, an upper slide block 302, a lower dovetail guide rail 303, a lower slide block 304, a rack 305, a rack fixing plate 306, and a forward and reverse servo motor 307 (provided with a gear on a motor shaft).

Figure 2:
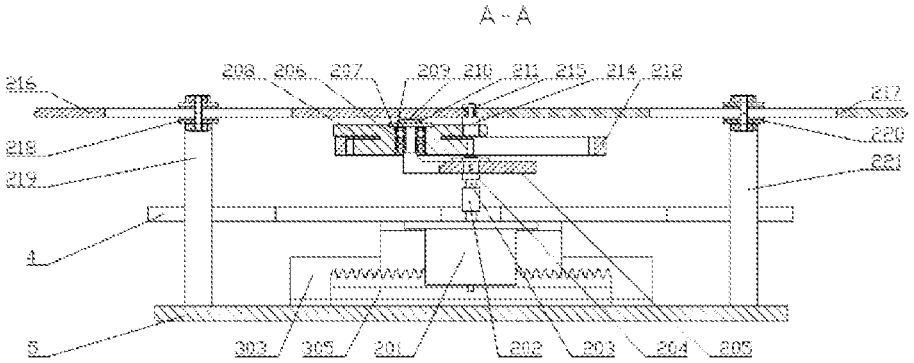
FIG. 2 is a cross-sectional view along A-A in FIG. 1.
Figure 3:
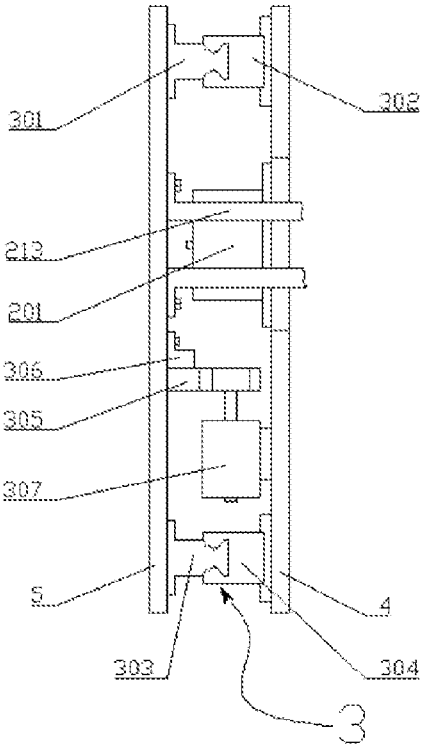
FIG. 3 is a partial view of left and right maneuvering parts in the bionic pectoral fin propelling device according to the present invention.
Figure 4:
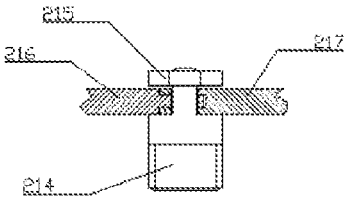
FIG. 4 is a structural view of hinged connection of pectoral fin connecting rods according to the present invention.

Referring to FIG. 1, FIG. 2 and FIG. 3, the fixed support plate 4 and the movable support plate 5 are arranged in the front-back direction, the power source 1 is fixedly connected to the lower part of the fixed support plate 4. The propelling part 2 is arranged on the fixed support plate 4, the drive servo motor 201 is fixedly installed on an inner surface of the fixed support plate 4, and an output shaft of the drive servo motor 201 passes through the fixed support plate 4 and is connected to the transmission shaft 203 through the coupler 202. The transmission shaft 203 is connected to the planetary carrier 205 through the key 204, an output shaft of the planetary carrier 205 is connected to the double-disc planetary gear 208 through a bearing, the first deep-groove ball bearing 206 and the second deep-groove ball bearing 207 are provided on the output shaft of the planetary carrier 205 and are installed in contact with each other, one end of the first deep-groove ball bearing 206 and the second deep-groove ball bearing 207 is limited by a shaft shoulder of the planetary carrier 205, and the other end of the first deep-groove ball bearing 206 and the second deep-groove ball bearing 207 is limited by the sleeve 209. An upper end of the sleeve 209 is pressed by the baffle plate 210, the baffle plate 210 is tightly pressed by the first nut 211, the baffle plate 210 is tightly pressed on the first deep-groove ball bearing 206 and the second deep-groove ball bearing 207 while it is ensured that a gap remains between the baffle plate 210 and the double-disc planetary gear 208, such that the double-disc planetary gear 208 is rotatable. A lower disc of the double-disc planetary gear 208 is internally engaged with the sun gear 212, the sun gear 212 is fixedly connected to the frame through the sun gear support pillar 213, a plurality of equally spaced threaded holes is drilled on a reference circle of an upper disc of the double-disc planetary gear 208, an butt end of the double-end stud 214 is connected to the double-disc planetary gear 208, and the left pectoral fin connecting rod 216 and the right pectoral fin connecting rod 217 are hinged at a tip end of the double-end stud 214, as shown in FIG. 4, and are limited by the second nut 215 at the tip end. By selecting different threaded holes, the double-end stud 214 may have different motion paths. The left pectoral fin connecting rod 216 and the right pectoral fin connecting rod 217 respectively pass through the left swinging block 218 and the right swinging block 220, and the left swinging block 218 and the right swinging block 220 are respectively hinged to the left swinging block fixing rod 219 and the right swinging block fixing rod 221 on the movable support plate 5. The left pectoral fin 6 and the right pectoral fin 7 are respectively fixed on a tail end of the left pectoral fin connecting rod 216 and a tail end of the right pectoral fin connecting rod 217. The left and right maneuvering parts 3 are located between the fixed support plate 4 and the movable support plate 5, the upper dovetail guide rail 301 and the lower dovetail guide rail 303 are symmetrically fixed on an upper end and a lower end of an inner surface of the movable support plate 5 respectively, the upper slide block 302 and the lower slide block 304 are respectively fixedly installed on the inner side of the fixed support plate 4, the rack 305 is located at a central position of the inner surface of the movable support plate 5 and is fixedly connected to the rack fixing plate 306, the rack fixing plate 306 is fixedly connected to the movable support plate 5, the forward and reverse servo motor 307 is fixedly installed on the inner side of the fixed support plate 4, and the installation requirement is to ensure good engagement between the gear on the rotary shaft of the forward and reverse servo motor 307 and the rack 305.

As for the double-disc planetary gear 208, the radius of the reference circle of the double-disc planetary gear 208 is half of the radius of a reference circle of the sun gear 212; 12 threaded holes are drilled on the reference circle of the upper disc of the double-disc planetary gear 208, and the threaded holes are equally spaced; by selecting different threaded holes, the double-end stud 214 may have different motion paths, and the motion path of the double-end stud 214 is to perform reciprocating motion along the diameter of the sun gear 212 where the double-end stud 214 is located, thereby resulting in different swinging amplitudes.

Figure 5:
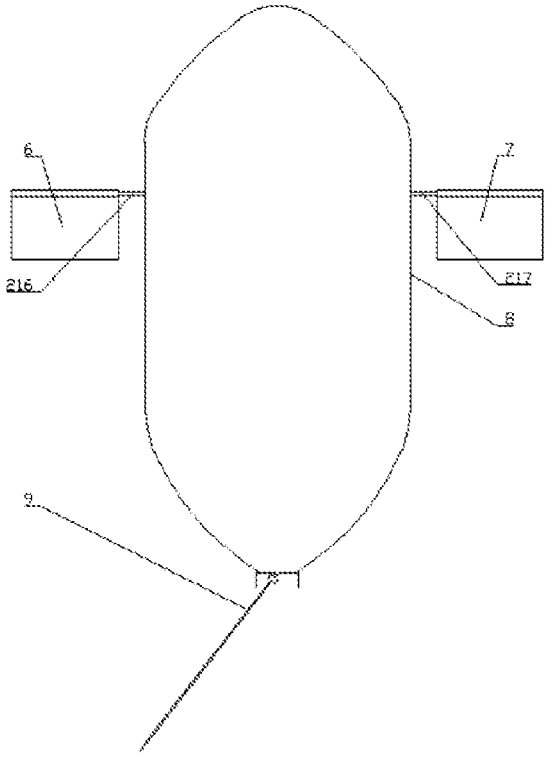
FIG. 5 is a view of an installation position of the bionic pectoral fin propelling device according to the present invention.

As shown in FIG. 5, the bionic pectoral fin propelling device is installed in the middle and front part of a fish body 8 of a robot fish, and drives the entire robot fish to move forward with the assistance of the tail fin 9.

The specific working process is as follows.

When the robot fish is linearly propelled, the servo motor 201 is connected to the transmission shaft 203 through the coupler 202 to drive the planetary carrier 205 to rotate, the double-disc planetary gear 208 installed on the planetary carrier 205 is engaged with the fixed sun gear 212 to achieve planetary motion, the double-end stud 214 arranged on the reference circle of the planetary gear performs reciprocating motion along the diameter of the sun gear 212 where the double-end stud 214 is located, the double-end stud 214 drives the left pectoral fin connecting rod 216 and the right pectoral fin connecting rod 217 that respectively pass through the left swinging block 218 and the right swinging block 220 and are hinged to the double-end stud 214 to perform reciprocating swinging, such that the left pectoral fin 6 and the right pectoral fin 7 flap up and down, and the robot fish is enabled to move forward.

Figure 6:
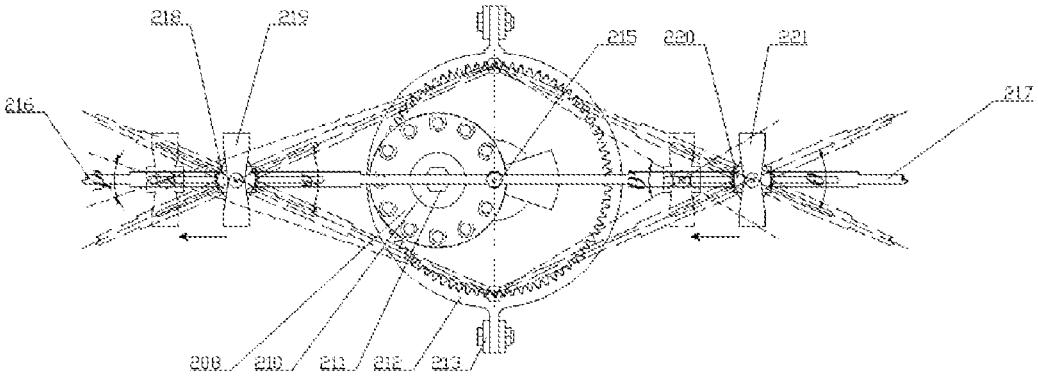
FIG. 6 is a schematic view of leftward maneuvering of the bionic pectoral fin propelling device according to the present invention.

When the robot fish requires left and right maneuvering in the advancing process, the forward and reverse servo motor 307 located on the inner side of the fixed support plate 4 receives a signal and starts rotation. When the robot fish needs to turn left, the forward and reverse servo motor 307 rotates forwardly, the gear on the shaft of the motor 307 is engaged with the rack 305, thereby driving the movable support plate 5 fixedly connected to the rack 305 to move leftward, as shown in FIG. 6, and the positions of the left swinging block 218 and the right swinging block 220, hinged to the movable support plate 5, relative to the double-end stud 214 are changed, such that the swinging amplitude of the right pectoral fin 7 is larger than the swinging amplitude of the left pectoral fin 6, the propulsion of the right pectoral fin 7 of the robot fish is larger than that of the left pectoral fin 6, and thus the robot fish turns left. Similarly, when the robot fish needs to turn right, only a signal instructing the motor to rotate reversely needs to be sent. The turning amplitude depends on both the number of rotation made by the forward and reverse servo motor 307 and the rotation speed of the drive servo motor 201.

The implementations of the present invention are specifically described in detail above, but they are not to be construed as limiting the scope of the present invention. It should be noted that several modifications and improvements can be made by one of ordinary skill in the art without departing from the concept of the present invention. All these modifications and improvements are within the protection scope of the present invention.

What is claimed is:

1. A bionic pectoral fin propelling device based on a planetary gear train, comprising a frame, a power source (1), a propelling part (2), left and right maneuvering parts (3), a fixed support plate (4), a movable support plate (5), a left pectoral fin (6), a right pectoral fin (7), a fish body (8), and a tail fin (9), the fixed support plate (4) and the movable support plate (5) being installed on the frame parallel to each other; the fixed support plate (4) being located in front of the movable support plate (5); and the left and right maneuvering parts (3) being located between the fixed support plate (4) and the movable support plate (5), wherein the propelling part (2) comprises a drive servo motor (201), a coupler (202), a transmission shaft (203), a planetary carrier (205), a double-disc planetary gear (208), a sun gear (212), a double-end stud (214), a left pectoral fin connecting rod (216), a right pectoral fin connecting rod (217), a left swinging block (218), a left swinging block fixing rod (219), a right swinging block (220), and a right swinging block fixing rod (221); the drive servo motor (201) is fixed on the fixed support plate (4), an output shaft of the drive servo motor (201) is connected to one end of the transmission shaft (203) through the coupler (202), and the other end of the transmission shaft (203) is connected to the planetary carrier (205); an output shaft of the planetary carrier (205) is connected to the central part of the double-disc planetary gear (208) through a bearing; the planetary gear (208) comprises an upper disc and a lower disc that are in parallel with each other, an outer gear of the lower disc is engaged with an inner gear of the sun gear (212), and a plurality of equally spaced threaded holes is provided on the periphery of a reference circle of the upper disc; the sun gear (212) is fixed on the frame and is located in front of the fixed support plate (4); one end of the double-end stud (214) is installed in one of the threaded holes of the upper disc, and the other end of the double-end stud (214) is hinged to the left pectoral fin connecting rod (216) and the right pectoral fin connecting rod (217); one end of the left swinging block fixing rod (219) and one end of the right swinging block fixing rod (221) are installed on the left and right sides of the movable support plate (5) respectively, the left swinging block (218) and the right swinging block (220) are fixed on the other end of the left swinging block fixing rod (219) and the other end of the right swinging block fixing rod (221) respectively, and the left pectoral fin connecting rod (216) and the right pectoral fin connecting rod (217) pass through the left swinging block (218) and the right swinging block (220), and are hinged to the left swinging block (218) and the right swinging block (220), respectively;

the left and right maneuvering parts (3) comprise an upper dovetail guide rail (301), an upper slide block (302), a lower dovetail guide rail (303), a lower slide block (304), a rack (305), and a forward and reverse servo motor (307) provided with a gear on a motor shaft; the upper dovetail guide rail (301) and the lower dovetail guide rail (303) are respectively fixed on an upper end and a lower end of a front end surface of the movable support plate (5), the upper slide block (302) and the lower slide block (304) are respectively fixedly installed on an upper end and a lower end of a rear end surface of the fixed support plate (4), and the upper dovetail guide rail (301) and the lower dovetail guide rail (303) are respectively in sliding fit with the upper slide block (302) and the lower slide block (304); the rack (305) is fixed on a central position of the front end surface of the movable support plate (5); the forward and reverse servo motor (307) is fixed on the rear end surface of the fixed support plate (4), and a motor gear engaged with the rack (305) is installed on an output shaft of the forward and reverse servo motor (307).

2. The bionic pectoral fin propelling device based on a planetary gear train according to claim 1, wherein the central parts of the two disc gears in the double-disc planetary gear (208) are fixedly connected to each other.

3. The bionic pectoral fin propelling device based on a planetary gear train according to claim 1, wherein the bearing between the output shaft of the planetary carrier (205) and the double-disc planetary gear (208) comprises a first deep-groove ball bearing (206) and a second deep-groove ball bearing (207), the second deep-groove ball bearing (207) and the first deep-groove ball bearing (206) contact each other and are installed in the front-back direction, and a rear end of the first deep-groove ball bearing (206) is limited by a shaft shoulder of the planetary carrier (205).

4. The bionic pectoral fin propelling device based on a planetary gear train according to claim 3, further comprising a sleeve (209) and a baffle plate (210), wherein a front end of the second deep-groove ball bearing (207) is limited by the sleeve (209), and an upper end of the sleeve (209) is pressed by the baffle plate (210).

5. The bionic pectoral fin propelling device based on a planetary gear train according to claim 4, further comprising a first nut (211), wherein the baffle plate (210) is tightly pressed on the sleeve (209) by using the first nut (211), and a gap remains between the baffle plate (210) and the double-disc planetary gear (208).

6. The bionic pectoral fin propelling device based on a planetary gear train according to claim 1, further comprising a key (204), wherein the transmission shaft (203) is connected to the planetary carrier (205) through the key (204).

7. The bionic pectoral fin propelling device based on a planetary gear train according to claim 1, further comprising a sun gear support pillar (213), wherein the sun gear (212) is fixedly connected to the frame through the sun gear support pillar (213).

8. The bionic pectoral fin propelling device based on a planetary gear train according to claim 1, wherein the double-end stud (214) comprises a butt end and a tip end, the butt end of the double-end stud (214) is connected to the double-disc planetary gear (208), and the left pectoral fin connecting rod (216) and the right pectoral fin connecting rod (217) are hinged at the tip end of the double-end stud (214).

* * * * *